United States Patent [19]

Piedboeuf et al.

[11] 4,374,873

[45] Feb. 22, 1983

[54] PROCESS AND INSTALLATION FOR COATING A METALLIC STRIP CONTINUOUSLY WITH A COVERING LAYER

[75] Inventors: Albert Piedboeuf, Chaudfontaine; Victor Polard, Awans; Andre Cornez, Liege, all of Belgium

[73] Assignee: Phenix Works Societe Anonyme, Flemalle, Belgium

[21] Appl. No.: 204,083

[22] Filed: Nov. 4, 1980

[30] Foreign Application Priority Data

Nov. 7, 1979 [LU] Luxembourg ..... 81865

[51] Int. Cl.[3] ..... C23C 17/00; B05C 1/08

[52] U.S. Cl. ..... 427/349; 118/63; 118/246; 427/428; 427/433

[58] Field of Search ..... 427/428, 349, 211, 433; 118/246, 249

[56] References Cited

U.S. PATENT DOCUMENTS 3,083,120 3/1963 Paterson ..... 427/211
4,172,911 10/1979 Michels ..... 427/428

OTHER PUBLICATIONS

Booth, Coating Equipment and Processes, 1970, Lockwood Pub. Co., New York, pp. 139, 140.

*Primary Examiner*—Ralph S. Kendall
*Attorney, Agent, or Firm*—Young & Thompson

[57] ABSTRACT

The metallic strip is displaced in a non-oxidizing gaseous atmosphere above and at a small distance from the surface of the coating bath and in contact with a coating cylinder driven to rotate in a direction opposite the direction of travel of the strip, so as to transfer onto the lower surface of the strip a thick layer of the coating material. Apparatus is arranged downstream of the coating cylinder to produce a jet of non-oxidizing gas directed to extend over the entire width of the strip, so as to adjust to a predetermined value the thickness of the coating layer.

6 Claims, 2 Drawing Figures

PROCESS AND INSTALLATION FOR COATING A METALLIC STRIP CONTINUOUSLY WITH A COVERING LAYER

BACKGROUND OF THE INVENTION

The present invention relates to a process and to an installation for coating a metallic strip continuously with a coating layer, for example a zinc-based coating.

A process exists for coating a steel strip with a coating layer, according to which the coating is applied to the strip by means of a coating cylinder immersed in the coating bath. This coating cylinder is in contact with the face of the strip to be coated and is driven to rotate in the direction of travel of the strip. In certain installations which carry out this process the coating cylinder is wiped by another cylinder of smaller diameter which is arranged upstream of the point of contact of the strip with the coating cylinder and in other installations the coating cylinder is immersed in the coating bath by less than half its lateral surface. Yet other installations make use of a back-pressure roller which is arranged against the face of the strip opposite that which receives the coating layer. Whatever the installation used, the process with coating cylinder has hitherto enabled only relatively little coating material to be applied to the strip and has thus limited the range of coating thicknesses which can be obtained.

The applicant has found that this limitation of thickness results from the fact that the layer of coating material applied by the coating cylinder to the strip is, in fact, wiped by the coating cylinder itself because of its rotation in the direction of travel of the strip. Moreover, in addition to limiting the thickness of the coated layer, the coating cylinder risks marking the layer and, in so doing, impairing the uniformity of the layer when changes in strip widths are made. In reality, according to this known process the effect of the coating cylinder is twofold: on the one hand, it transfers the coating material onto the strip and, on the other hand, at the same time, it wipes the coating layer and limits the thickness of same.

The problem arising with the known process is therefore that the thickness of the coating layer remains limited.

SUMMARY OF THE INVENTION

The invention aims to avoid this limitation by providing a process for coating a metallic strip, which enables a coating layer to be obtained, whose thickness is greater than that of the layers practicable hitherto.

This result is obtained by means of a process for coating a metallic strip, according to which the strip is displaced in a non-oxidizing atmosphere above and at a small distance from the surface of the coating bath and in contact with a coating device which applies at a predetermined speed a thick layer of coating material in a direction opposite the direction of travel of the strip, the thickness of the coating layer carried along by the strip being adjusted downstream of the coating device by means of a jet of a non-oxidizing gas which extends over the entire width of the strip.

To put this process into effect, the object of the invention is likewise the provision of an installation comprising a sealed enclosure which contains the coating bath surmounted by a gaseous phase, means to displace the strip above and at a small distance from the surface of the bath and a coating cylinder partially immersed in the bath, and in which the coating cylinder is driven to rotate in a direction opposite the direction of travel of the strip, so as to transfer onto the lower surface of the strip a thick layer of the coating material. The installation also contains, arranged downstream of the coating cylinder, means to produce a jet of non-oxidizing gas directed to extend over the entire width of the strip, in order to adjust to a predetermined value the thickness of the coating layer. Advantageously, the surface of the coating cylinder can have one or more grooves, in order to promote the regular carrying along of the covering material and its uniform deposition on the metallic strip.

BRIEF DESCRIPTION OF THE DRAWINGS

The invention is described in detail below with reference to the attached drawing in which.

DESCRIPTION OF AN EMBODIMENT

Figure 1:
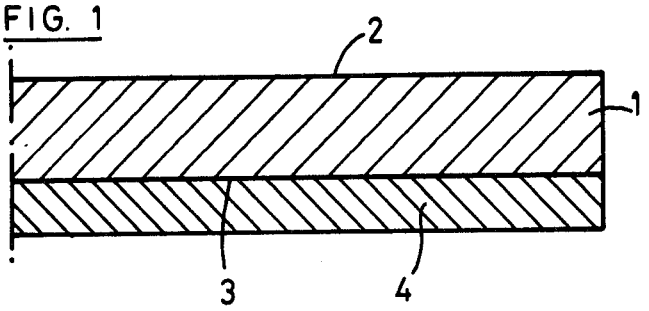
FIG. 1 is a section of part of a steel strip manufactured according to the invention.

The purpose of the process and of the installation described here is to coat continuously a face 3 of a metallic strip 1, for example a steel strip, with a coating layer 4, for example a zinc-based coating (FIG. 1).

Figure 2:
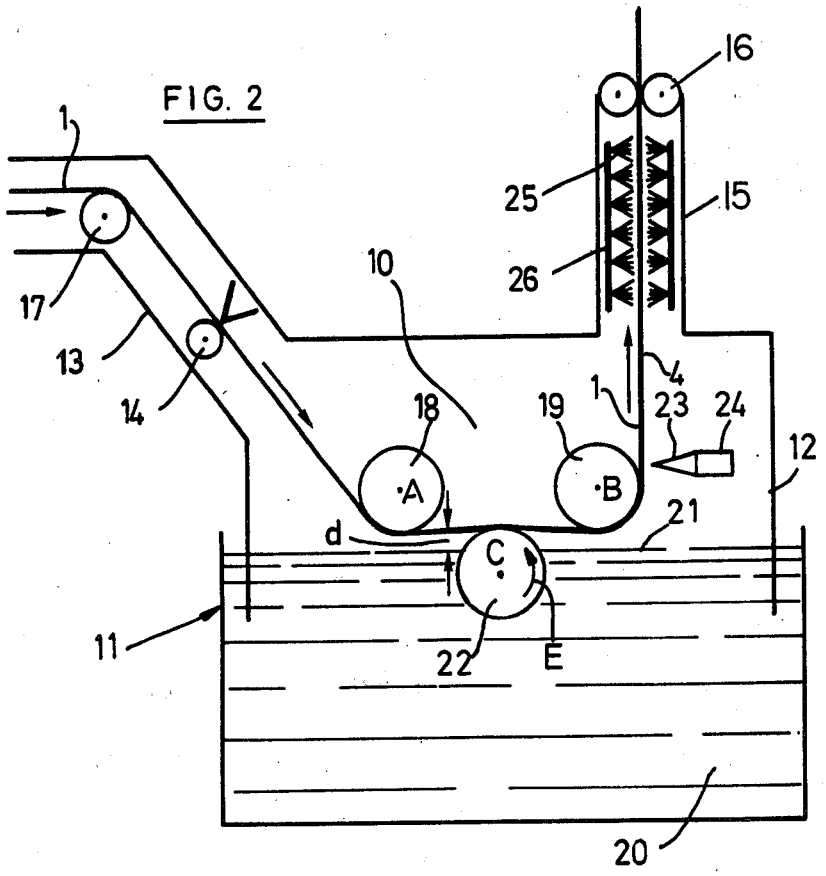
FIG. 2 is a schematic vertical section of the installation according to the invention.

Referring to FIG. 2, the installation comprises a sealed enclosure 10 formed by a tank 11 which contains a coating bath 20, for example a bath of molten zinc, and a bell-cover 12 whose vertical side walls are partially immersed in the zinc bath. The bell-cover 12 has an inclined inlet channel 13 equipped with a sealing lock 14 as well as a vertical outlet channel 15 provided with a sealing lock 16.

The continuous strip 1 is conveyed horizontally to the entrance of the inlet channel 13 where it is bent by a guide cylinder 17. The strip 1 is displaced flat in the inlet channel, passes through the lock 14 and penetrates under the bell-cover 12 according to the inclination of the channel 13. Under the bell-cover 12 the strip 1 passes via two guide cylinders 18 and 19 which turn freely about their parallel horizontal axes A and B. Between the guide cylinders 18 and 19 the strip 1 is displaced horizontally, then, after passing over the guide cylinder 19, the strip 1 is displaced vertically in the centre plane of the outlet channel 15, finally passing through the lock 16. Under the bell-cover 12 and in the channels 13 and 15 there prevails a neutral or reducing gaseous atmosphere composed of e.g. nitrogen. During its entire passage on the inside of the enclosure 10 the strip 1 is situated constantly in the non-oxidizing gaseous phase.

The axes of rotation of the guide cylinders 18 and 19 are situated at such a height that, during the horizontal part of its passage between the said two cylinders, the strip 1 is displaced above and at a small distance d from the surface 21 of the zinc bath 20, for example between 20 and 300 mm as will be explained below.

Mounted beneath the strip, in the enclosure and between the positions of the guide cylinders 18 and 19, is a coating cylinder 22 whose horizontal axis of rotation C is parallel to the axes of the guide cylinders 18 and 19. The axis C of the cylinder 22 is situated beneath the surface 21 of the zinc bath, so that the cylinder 22 partially emerges from the surface 21 of the bath and rolls against the lower surface of the strip 1. The rotation of the coating cylinder 22 is controlled from outside the enclosure 10 and has a direction opposite the direction of travel of the strip 1, as indicated by the arrow E. The coating cylinder 22 picks up a thick and continuous layer of liquid zinc from the bath and transports this layer upwards until it makes contact with the lower surface of the strip 1. The result of this is that the strip 1 carries along on its lower face a continuous and thick layer of liquid zinc over its entire width. The surface of the coating cylinder 22 can advantageously have one or more grooves, so as to promote a regular carrying along of the covering material and its uniform deposition on the metallic strip.

The quantity of zinc picked up by the coating cylinder 22 and, consequently, the quantity of zinc transferred to the strip 1 are governed by the speed of rotation of the coating cylinder 22. This speed must be such that the linear speed of the coating cylinder is not too low, since otherwise the quantity of zinc picked up would be too small and, if the linear speed were too high, there would be a risk of centrifugal splashing. A typical linear speed is located within the range from about 10 to about 100 m/min. It has been found experimentally that the use of a coating cylinder turning in a direction opposite the direction of travel of the strip at a speed within the proposed range makes it possible to transfer to a steel strip a relatively large quantity of zinc in comparison with the quantity applied by a conventional double-faced galvanising process (about 500 g/m$^2$).

In order to neutralize or minimize the influence of an imperfect planeness of the surface of the strip on the uniformity of coating, the coating cylinder 22 can advantageously be placed so as to impress on the strip, at the point of tangency with the coating cylinder, a slight deflection in height which can amount e.g. to 50 mm, typically 5 to 25 mm.

The degree to which the coating cylinder 22 emerges from the zinc bath will now be discussed. It was stated above that the point of tangency of the coating cylinder 22 with the strip 1 is situated at a distance of the order of 20 to 300 mm above the surface 21 of the bath 20. If the height of emergence is too small, the movements of the liquid zinc risk causing the liquid zinc to touch the guide cylinders 18 and 19. On the other hand, if the height of emergence is too large, the quantity of zinc carried by the coating cylinder 22 to its point of tangency with the strip risks being too small.

The thickness of the layer of liquid zinc carried by the moving strip 1 is adjusted and made uniform in the bell-cover 12 by a jet of non-oxidizing gas, for example a jet of nitrogen, projected over the entire width of the strip 1 during its vertical passage downstream of the guide cylinder 19. The respective jet of gas is produced e.g. by a slit 23 of a horizontal nozzle 24 supplied with suitable gas. The nozzle is arranged e.g. a little above the plane of the axes of rotation of the guide cylinders 18 and 19, at the start of the vertical part of the passage of the strip 1. The injection pressure, the direction and the positioning of said jet are advantageously adjustable.

From the level of the jet 23 the strip 1 coated on one face with a uniform covering layer passes into the outlet channel 15. The covering layer is cooled uniformly therein so as to be solidified before the exit of the strip 1. The cooling of the covering is effected by jets of a non-oxidizing gas, in the event nitrogen, said jets being projected onto the bare face of the strip 1 and onto the covering layer 4. The jets of nitrogen come from injectors 25 provided on gas manifolds 26 arranged on either side of the strip 1. After the covering layer 4 has been cooled and solidified, the strip 1 passes through the outlet lock 16 and leaves the enclosure 10.

It is clear that the invention is not limited exclusively to the embodiment illustrated and that modifications can be made in the form, the arrangement and the composition of some of the elements involved in its realization.

The experimental results have shown that the invention enables a covering to be obtained which has a considerable thickness together with an excellent regularity and quality. Experimentally, it was possible, with the above-described process and installation, to obtain, on a steel strip 0.75 mm thick and 1000 mm wide travelling at a speed of 25 meters per minute, covering layers of adherent zinc having thicknesses of the order of 5 to 15 microns (quantity of zinc from 35 to 105 g/m$^2$), according to the pressure of the jet of non-oxidizing gas (nitrogen at a pressure of 1 to 10 kPa), under the following operating conditions:

| | |
|---|---|
| speed of rotation of the coating cylinder: | 25 revolutions per minute |
| distance between the strip and the surface of the zinc bath: | 140 mm |
| diameter of the coating cylinder: | 520 mm |
| deflection of the strip at the point of tangency with the coating cylinder: | 10 mm |
| relative pressure of the gas under the bell-cover | 40 Pascals |
| concentration of oxygen under the bell-cover | 45 ppm |

With the jet of nitrogen being cut off, the quantity of zinc in the layer varied up to about 650 g/m$^2$.

What is claimed is:

1. A process for coating a metallic strip continuously with a coating layer, in which the strip is displaced in a non-oxidizing gaseous atmosphere above and at a small distance from the surface of the coating bath and in contact with a rotatable coating device, rotating said coating device at a predetermined speed in a direction such that its top moves in a direction opposite to the direction of travel of the strip to apply in one step a thick layer of coating material, adjusting the thickness of the coating layer carried along by the strip downstream of the coating device by applying a jet of a non-oxidizing gas to the strip over the entire width of the strip, and deflecting the strip upwardly about said rotatable coating device.

2. A process according to claim 1, in which the distance of said deflection is 5 to 25 mm.

3. An installation for coating a metallic strip continuously with a coating layer, comprising a sealed enclosure for containing a coating bath surmounted by a gaseous phase, means to displace the strip in a direction above and at a small distance from the surface of the bath, a coating cylinder adapted to be partially immersed in the bath, such that it contacts and deflects the strip at the point of tangency by a defined distance, said coating cylinder being driven to rotate in a direction such that its top moves in a direction opposite to the direction of travel of the strip, so as to transfer in one step onto the lower surface of the strip a thick layer of the covering material, and means downstream of the coating cylinder to produce a jet of non-oxidizing gas directed to extend over the entire width of the strip, so as to adjust to a predetermined value the thickness of the covering layer.

4. An installation according to claim 3, in which the linear speed of the coating cylinder is within the range from about 10 to about 100 meters per minute.

5. An installation according to claim 3, in which the coating cylinder emerges, at its point of tangency with the strip, from the surface of the covering bath by a distance within the range from about 20 to about 300 mm.

6. An installation according to claim 3, in which said defined distance of deflection is 5 to 25 mm.

* * * * *